US005381964A

United States Patent [19]

Reyna

[11] Patent Number: 5,381,964

[45] Date of Patent: Jan. 17, 1995

[54] WATER JET SPRAY NOZZLE FOR CLEANING A PAINTBRUSH

[76] Inventor: John M. Reyna, P.O. Box 1186, Cape Coral, Fla. 33910-1186

[21] Appl. No.: 18,074

[22] Filed: Feb. 12, 1993

[51] Int. Cl.[6] ..... B05B 1/14

[52] U.S. Cl. ..... 239/566; 239/548

[58] Field of Search ..... 134/172, 199; 239/566, 239/548, 110, 104, 597, 754

[56] References Cited

U.S. PATENT DOCUMENTS

| | | | |
|---|---|---|---|
| D. 243,610 | 3/1977 | Craig | 239/754 |
| 734,887 | 7/1903 | Kilgore | 239/379 |
| 1,863,685 | 6/1932 | Covey | 239/566 |
| 2,709,112 | 5/1955 | Curtice | 239/548 |
| 3,508,709 | 4/1970 | Small et al. | 239/754 |
| 4,022,382 | 5/1977 | Engdahl, Jr. | 239/566 |
| 4,095,746 | 6/1978 | Anderberg et al. | 239/754 |
| 4,447,917 | 5/1984 | Walter | 239/548 |
| 4,930,706 | 6/1990 | Merlin | 239/754 |

*Primary Examiner*—Andres Kashnikow
*Assistant Examiner*—Christopher G. Trainor
*Attorney, Agent, or Firm*—Richard D. Slehofer

[57] ABSTRACT

A paintbrush cleaning apparatus is fabricated from a molded plastic material with five attached metallic water jet sprayers. The housing is hollow and form a T-shape, a triangle, or a regular rectangle. A hollow stem extends from the housing and has a female threaded end for connecting to the end of a garden hose. The garden hose supplies pressurized water from a water faucet. The housing has a face portion opposite the stem for mounting a bank of water jet sprayers. Each of the water sprayers is formed as a thin hollow needle with an open tip, a small sideport inboard from the tip, and an enlarged hollow base. The base of each sprayer needle is mounted on the face portion of the housing. The five sprayer needles are separated and aligned in a row. The row of needles is angled relative to the stem so that the apparatus resembles a lawn rake. The stem can be formed as a handgrip and lever, or a ball valve can be attached at the end of the stem to control the water flow at the apparatus. The user holds the stem and manipulates and controls the apparatus so that the tips of the extended needles are in the heel area of the paintbrush while the water is running to flush out any paint residue to clean the paintbrush after use. The water exits the tips and the sideports near the tips under increased pressure causing water turbulence and a cleansing action.

14 Claims, 2 Drawing Sheets

WATER JET SPRAY NOZZLE FOR CLEANING A PAINTBRUSH

BACKGROUND OF THE INVENTION

1. Field of the Invention

The present invention pertains to the following areas of technology—BRUSHING, SCRUBBING AND GENERAL CLEANING; IMPLEMENTS 0R ATTACHMENTS OR ACCESSORIES.

FLUID SPRINKLING, SPRAYING AND DIFFUSING; having a Flow Line or Nozzle or Carried Handgrip or Handle.

FLUID SPRINKLING, SPRAYING AND DIFFUSING; having a Rigid Fluid Confining Distributor; with an interior filter or guide; and with plural directing means.

2. Description of the Prior Art

Most interior paints fall into one of two broad categories: water-thinned latex paints, and solvent-thinned oil-base or alkyd-base paints. The latex finishes are by far the most popular, because they offer a number of advantages including the convenience that they thin with water, so the painter can wash his tools and paintbrushes in water and clean up smears on hands or clothing with a damp cloth.

A flat wall brush can vary from 3" to 6" inches in width with thicknesses of ¾" to 1½ inches and bristles from 2" to 7" inches long. A flat wall brush is best suited for painting large surfaces such as walls, ceilings and floors. Flat chisel-shaped varnish brushes range from 1" to 3½" inches in width, with bristles from 2" to 4½" inches long. They are ideally suited for painting baseboards, window frames, narrow boards, or enameling and varnishing furniture and small panels.

A typical paintbrush has a handle, a heel, and a collection of bristles attached to the heel with a metal band called a ferrule. Bristles are made of synthetic materials such as nylon or polyester filament. The job that people seem to dread most when painting is cleaning the paintbrush after use. It is a messy and time-consuming procedure. Thorough cleaning of the paintbrush is required in order to keep the paintbrush in good working condition for reuse. Good quality paintbrushes are too expensive to be discarded after a single use. Quality is a very important factor in selecting a brush, regardless of the size or style needed for a particular project. A good brush will hold more paint and enable one to apply the paint more smoothly and with less effort. A quality brush is a fine tool and should be properly used and cared for. Cheap "throwaway" brushes will save the job of cleaning the brush after use, but the quality of the paint job is unacceptable. Improper or incomplete cleaning of the paintbrush after use will result in stiff bristles that have lost their resiliency or springiness, because of a coating of dried paint residue left on the bristles. Stiff bristles cause inferior application of the paint to the surface being painted.

Paintbrushes are cleaned while still soft after painting by rubbing as much excess paint out of the bristles as possible by wiping the brush across the rim of the paint can, then by rubbing back and forth on a stack of old newspaper. To clean the brush of water-thinned paint, the brush is washed in running tap water, or in several changes of water in a pail, preferably with a little detergent added. A wirebrush is used to breakup any dry paint remaining on the brush and especially near the heel. The painter must be particularly careful to wash up near the heel of the brush, and work the bristles between the fingers to make certain that all of the paint has been washed out. The bristles are then smoothed out and any tangles can be separated with a special metal comb. The brush is then laid flat to dry. Afterwards the bristles are wrapped with a sheet of heavy paper or foil to protect them. The paintbrush is then stored away in a safe place for later use.

SUMMARY AND OPERATION OF THE INVENTION

A paintbrush cleaning apparatus is fabricated from a molded plastic material with five attached metallic water jet sprayers. The housing is hollow and can form a T-shape, an L-shape, a triangle, or a regular rectangle. A hollow stem extends from the housing and has a female threaded end for connecting to the end of a garden hose. The garden hose supplies pressurized water from a water faucet. The housing has a face portion opposite the stem for mounting a bank of water jet sprayers. Each of the water sprayers is formed as a thin hollow needle with an open tip, a small I sideport inboard from the tip, and an enlarged hollow base. The base of each sprayer needle is mounted on the face portion of the housing. The five sprayer needles are separated and aligned in a row. The row of sprayer needles is angled relative to the stem so that the apparatus resembles a lawn rake. The stem can be formed as a handgrip and lever or a ball valve can be placed at the end of the stem to control the water flow at the apparatus. The user holds the stem and manipulates and controls the apparatus so that the tips of the extended water sprayer needles are in the heel area of the paintbrush while the water is running to flush out any paint residue to clean the paintbrush after use. The water exits the tips and the sideports near the tips under increased pressure causing water turbulence and a cleansing action.

As stated in the Background of the Invention, after finishing a paint job, the painter must be particularly careful to wash up near the heel of the brush, and work the bristles between the fingers to make certain that all of the paint has been washed out. This is the critical part of the cleaning process, and takes several minutes to accomplish. The present invention is a device that can be used by the painter to greatly speedup the process of washing and cleaning the paintbrush and also results in a very clean brush free of paint residue.

The present invention is a water jet spray nozzle for cleaning a paintbrush. It can be attached to or otherwise threaded onto the end of a garden hose as a conventional water nozzle attachment and used to clean a paintbrush after painting. In one variant, the present invention can have a T-shaped housing formed by a transverse hollow head portion and a hollow longitudinal stem portion that extends perpendicularly from the transverse head portion. The free end of the stem has a female threaded connection or fitting into which can be attached the male threaded coupling end of a conventional garden hose. The tubular head portion of the present invention has a plurality of five aligned water sprayer needles in spaced relationship to each other and extending from the surface opposite that of the stem. The row of water jet spray needles is angled relative to the axis of the stem. Each needle is hollow and has a base, a stem, an open tip, and a small sideport located inboard from the tip. The base of each needle is secured to the wall of the transverse head portion so that pressurized water 2 from the garden hose can enter the needles and exit out the sideports and the tips of the needles allowing pressurized water to flush and irrigate the bristles of the paintbrush being cleaned.

A variant of the T-shaped housing configuration illustrated in the drawings can be a triangle-shaped hollow housing. The top and bottom of the housing are generally triangle-shaped and are sealed together with an integral perimeter. The apex area of the triangle has a fitting for connecting to the male end of a water hose. A row of water jet spray needles extending from the face of the base portion of the triangle-shaped housing.

Another variant of the T-shaped housing configuration illustrated in the drawings can be the cylinder-shaped head portion having a plurality of water jet spray needles extending perpendicularly from the outside wall or face of the head. The stem has been modified relative to the stem in the preferred embodiment. A handgrip or handle has been interposed between the end of the stem and the female fitting. The handle provides a larger section for the user to grasp while using this first variant. It forms a configuration similar to a cleaning attachment used with the hose of a canister-type of vacuum cleaner. The user can grasp the stem to direct and control the needles while holding the paintbrush being cleaned in the other hand.

In any of the variants of the present invention described herein, the end of the stem can be modified to include a handgrip portion so that the user can grasp it with his hand to easily manipulate the device. The water hose fitting can be incorporated at the base of the handgrip for connecting it to the end of a garden hose. In effect the handgrip is interposed between the end of the stem and the female hose fitting.

Additionally, in any of the 3 or more variants described herein, there can be a water control means incorporated in the stem or handgrip portion of the present invention. The water control means can be a squeezable lever forming a part of the handgrip to decrease or stop the water flow from the garden hose depending upon how much the user squeezes the lever. As the user squeezes the lever towards the handgrip, more water flows through the needles in the head portion. As the lever is released, the water flow decreases and finally stops. The water flow can also be adjusted at the faucet.

As a alternate, the water control means can be a valve incorporated with the stem of the present invention or positioned between the end of the stem and the end of the water hose, like a coupling and having a valve to decrease or stop the water flow at the device rather than having to make a trip to the faucet to turn off the water at the other end of the hose.

In operation, the painter connects the stem of the water jet spray nozzle to the end of a garden hose, which in turn is connected to a water faucet, and then turns on the water at the faucet. He then holds the paintbrush to be cleaned in his left hand while holding the present invention in his right hand. The painter manipulates the present invention to direct and control the jet sprays of water emanating from the needle tips in the heel area of the paintbrush. The pressurized water from the faucet or tap exits the open tips and sideports in the needles under high pressure to flush out all remaining paint left in the bristles and particularly near the heel of the paintbrush. The needles act as a venturi to dramatically increase the water pressure exiting at the tips and sideports of the needles. The operation is fast, efficient, and thoroughly cleans the paintbrush and rids it of any paint residue. By using the present invention to clean each paintbrush, the cleaning operation saves at least ten minutes compared to cleaning each brush manually as described in the Background of the Invention. It takes about fifteen minutes to manually clean a paintbrush. After the user becomes proficient using the present invention, he or she can clean a paintbrush in less than two minutes.

DETAILED DESCRIPTION OF THE PREFERRED EMBODIMENT

Figure 1:
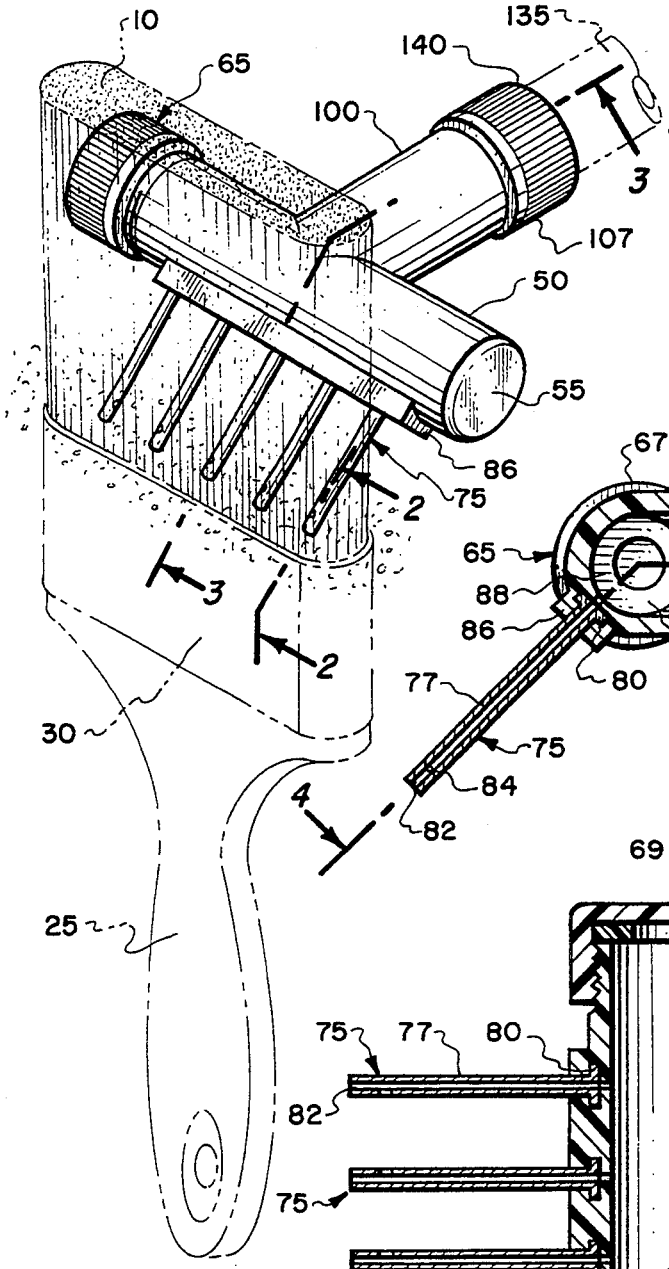
FIG. 1 is an isometric projection of the present invention illustrating the nozzle correctly positioned while flushing a paintbrush with pressurized water to clean the paintbrush by removing any paint residue.

The present invention is illustrated in FIG. 1 positioned correctly for cleaning a paintbrush with a pressurized liquid such as water by flushing away any residual paint left on the bristles 10 and particularly at the heel portion 20 of the paintbrush. The profile of a typical paintbrush is illustrated in ghost lines. The handle 25 and the metal band 30, called a ferrule, adjacent the heel 20 of the paintbrush are illustrated in FIG. 1. The ferrule 30 secures the bristles 10 to the handle 25. Stainless steel and aluminum are generally used for the ferrule on better-grade brushes for greater resistance to corrosion. The male end of a liquid conduit 135 such as a 50′ foot ¾″ inch or 1″ inch diameter flexible garden hose is illustrated in ghost lines attached to the stem 100 of the present invention. The other end of the hose can be attached to an outside water faucet (not shown). The water faucet can be turned on to supply water under pressure through the garden hose 135 to the present invention. The typical garden hose has a female coupling at one end and a male coupling at the other end. Most households have male faucets for attaching the female end of the garden hose. The male end of the garden hose is used to attach a hose nozzle or a lawn sprinkler. Most households have a static water pressure of around 60 p.s.i., which is more than sufficient water pressure for the present invention.

Figure 4:
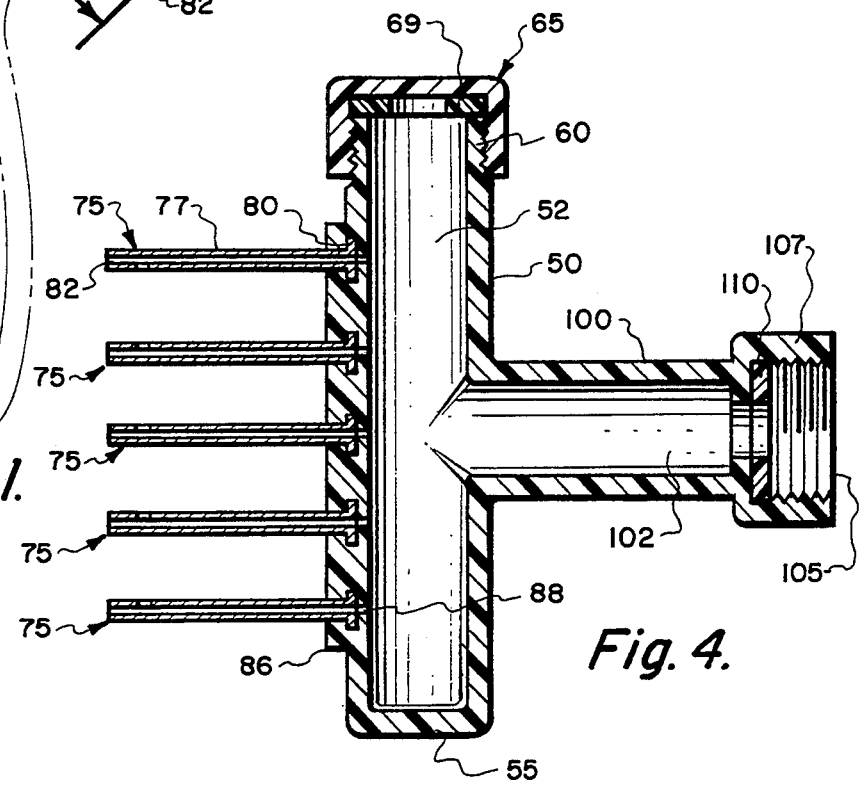
FIG. 4 is a full longitudinal sectional view taken along the line 4—4 of FIG. 3.

In FIG. 1, the T-shaped housing forming the water jet spray nozzle is illustrated in an isometric projection. The head means portion of the nozzle is illustrated as a transversely positioned cylinder-shaped hollow head 50. The head 50 forms the cross-bar of the T-shape. The connecting means extending from the head for connecting to a liquid conduit is illustrated as a stem 100. The stem 100 forms the leg of the T-shape. The T-shaped configuration is clearly illustrated in FIG. 4. The head and stem combination is referred to as the housing. The stem can be secured at one end of the head to form an L-shaped housing. The open end of the stem 100 has a cylinder-shaped fitting 107 having a cylinder-shaped female threaded opening 105 for threadably receiving the male threaded coupling 140 of the male end of a conventional garden hose. The male threaded coupling 140 is 1" inch in diameter. The female threaded socket 105 in the fitting 107 is also 1" inch in diameter. A rubber ring-shaped washer 110 is positioned in the base of the female threaded socket or opening 105. In order to connect the present invention to the garden hose, the male coupling 140 of the garden hose 135 is positioned in the female opening or socket 105 in the fitting 107 at the end of the stem 100, and the present invention is turned clockwise to thread it onto the male end of the hose until it cannot be turned any further. The male end 140 of the hose 135 projects into the female opening or socket 105 of the fitting 107 at the end of the stem 100. The rim of the male hose coupling presses against the washer 110 to form a water tight seal at this connection. The washer 110 can be modified to include a fine mesh screen to trap grit and dirt carried along in the tap water to prevent the grit from clogging the needles 75.

In the preferred embodiment the socket 105 in the fitting 107 has a female configuration for coupling to the free male end of a conventional garden hose. The connection to a fluid supply, however, could be a male coupling, a quick-release coupling, or a hose permanently attached to the present invention. Additionally, the fitting 107 can be attached to the stem just as the female end of the garden hose is attached to the hose so that the fitting 107 can turn relative to the stationary stem to make it easier to attach the male end of the garden hose to the present invention.

Both the stem portion 100 and the head portion 50 are approximately ¾" inches in their outside diameters. The stem portion 100 has a hollow cylinder-shaped chamber 102, and the head portion 50 also has a hollow cylinder-shaped chamber 52 for allowing fluid to flow through them. Either one or both ends of the head portion can be permanently sealed. One end such as the left hand end 55 of the head 50 can be permanently sealed, and the other end openable to allow easy cleaning of the housing. In the preferred embodiment, the other end or right hand end has a male threaded opening 60. A cylinder-shaped cap 65 having a female threaded cylinder-shaped opening or socket is threadably secured to the open end of the head 50. The outside cylinder portion of the cap 65 has a circular array of longitudinal flutes 67 to provide a better grip for the user to easily tighten or unscrew the cap 65 to clean the present invention whenever necessary. A ring-shaped rubber washer 69 is positioned at the end of the male threaded opening 60 to form a water tight seal with the cap 65. After prolonged use, pieces of grit from the water supply can become lodged in the chamber of the head 50 and the needles 75 to clog and plug the present invention. Also, dried paint residue buildup can clog and plug the needles 75. An occasional flushing can rid these contaminants to ensure that the present invention is working properly. The flushing action is accomplished by unscrewing the cap 65 and letting the tap water flow through and out the open end of the head 50. If necessary, a small brush can be passed back and forth in the chamber 52 of the head and the chamber 102 of the stem to dislodge any stubborn debris. A thin section of copper wire or a sewing needle can be passed through the needles 75 to clear them of any grit or paint residue.

Figure 2:
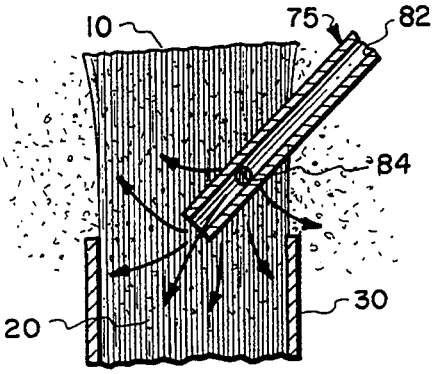
FIG. 2 is a fragmentary transverse sectional view taken along the line 2—2 of FIG. 1.

The cap 65 having the female socket and the male threaded end 60 of the head can be modified as follows: a removable rubber plug can replace the cap to seal the end; the male threaded end 60 can be changed to a female threaded end, and a male plug can be substituted for the cap 65; or the end 60 can have a circular flange around the opening, and an elastic rubber cup can be stretched over the opening and secured by the flange to seal the opening. A row of water jet means 75 is positioned in and extend from the wall of the transverse head 50 to allow pressurized liquid from the conduit means to pass through the water jet means to clean the paintbrush. The conduit means is illustrated as the garden hose 135. The water jet means is illustrated as a row of five aligned thin hollow metallic needles 75 with their bases 80 anchored or otherwise seated in the wall of the housing portion 50. Each needle 75 has a stem 77 and a circular flange 80 forming the base, which is embedded or otherwise secured in the material forming the wall of the housing portion 50. The stem and base have an axial bore or lumen 82 passing therethrough. The portion of the needle extending from the housing is about 1½" inches in length and about ⅜" inches in outside diameter. The diameter of the lumen 82 is about 1/16" inch. The flange 80 is about ¼" inch in diameter. A side port 84 is located in the wall of the stem 75 inboard from the tip of the stem 75. Each side port 84 assists in the agitation and cleansing of the paintbrush. The cleaning and agitation are clearly illustrated in FIG. 2. The number of needles 75 can vary depending on the size of the paintbrush to be cleaned. Optimally, the needles 75 are spaced equally about ⅝" inches apart. The side ports 84 in the needles are optional. The present invention can function very effectively without them.

Figure 3:
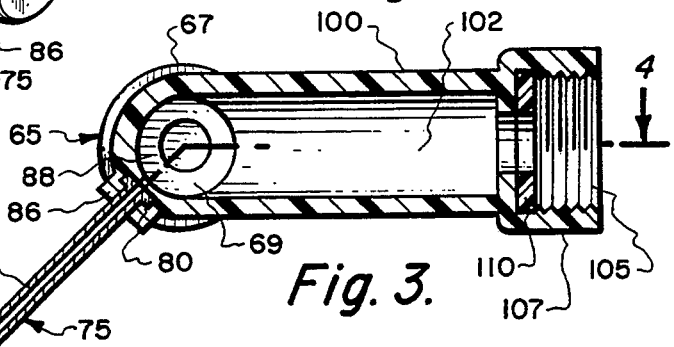
FIG. 3 is full transverse sectional view taken along the line 3—3 of FIG. 1.

The outside wall of the housing portion 50 opposite that of the stem 100 has a raised projection 86 or rib positioned longitudinally on the outside wall. The rib provides a support base for the flange ends 80 to be properly secured to the housing 50. This is clearly illustrated in FIG. 3 and FIG. 4. The flanges of the needles are properly placed and aligned into the rib area 86 during the fabrication and molding process to manufacture the present invention. After the molding process has been completed, a small drill is inserted in the lumen 82 of each needle 75 to bore a hole 88 into the chamber 52 of the housing 50 to allow a passageway for the water. The diameter of the hole 88 is the same as the diameter 82 of the needle 75. In an alternative method of manufacture, the face of the rib 86 is planar and is raised slightly above the outside wall of the housing 50. A stepped hole is drilled to seat each needle. The smaller portion of the stepped hole is 88 and the large portion of the stepped hole receives the flange 80 of the needle 75. The flanges of the needles are seated in the larger portion of the stepped holes, and then a cover plate 87 having holes to allow the needle stems to pass through is secured against the planar rib surface to hold the bases of the needles securely in place. The angle of the needle stems 77 relative to the housing 50 and stem 100 is important. In FIG. 3 the angle is 45° degrees. The axis of each needle's stem 77 is 45° degrees relative the axis of the stem 100. As illustrated in FIG. 1, the 45° degree angle of the five needles relative to the axis of the stem, which the user grasps while using the present invention, allows for easy manipulation of the device while cleaning the paintbrush. The 45° degree angle is optimal. Any angle from 0° degrees to 90° degrees can be suitable. The number of needles and their spacing can also be varied to fit a particular type of cleaning operation. The needles as illustrated in FIGS. 1–4 are equally spaced and the axes of the stems 77 are parallel to one another and aligned on the same plane. The stems extend radially from the axis of the housing 50. The needles do not necessarily have to be aligned in a row. The stems of the needles can form a fan-shape with the end ones being longer so that the tips of the row of needles form a straight line. The needles can be located on the wall of the housing in a staggered fashion relative to one another. These configurations could be useful in cleaning other types of painting equipment.

Optimally the needles should be made from metal for strength. For durability, the needles have to be stiff and sturdy so that they will not bend or break after prolonged use. The needles can be fabricated as integral plastic extensions from the housing during the molding process. The only requirement is that the plastic material used in the mold be sufficiently strong to avoid easy breaking of the stems. In an inexpensive version the housing can be sealed at both ends, the needles can be integral extensions from the wall of the housing, and the invention can be fabricated as a one-piece article of manufacture from an injection mold, even from blow molding process. This version can be used by the occasional painter who does not require a durable version of the present invention.

Figure 5:
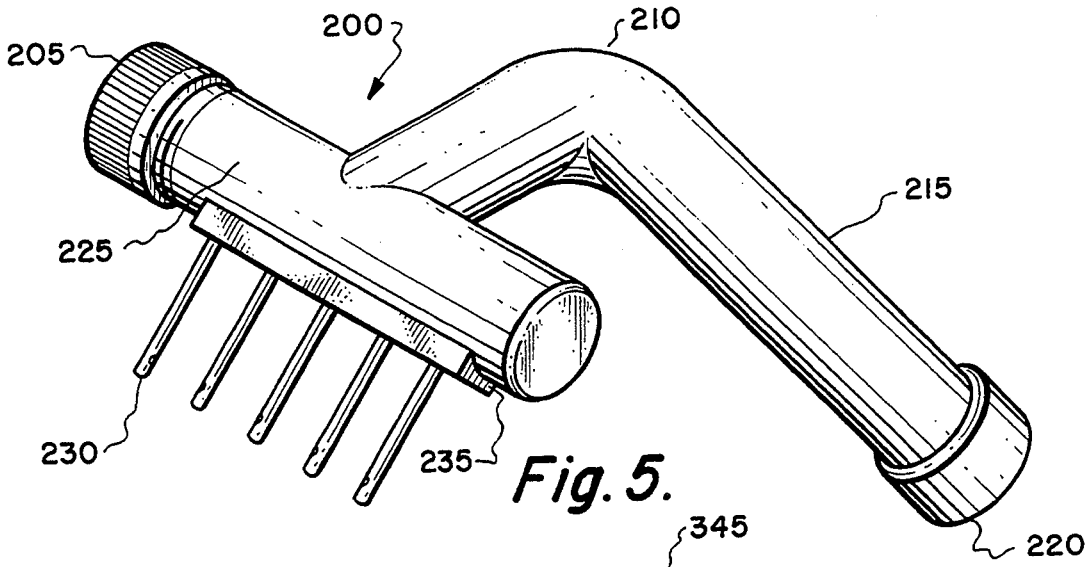
FIG. 5 is a first variant with a handgrip handle.
Figure 6:
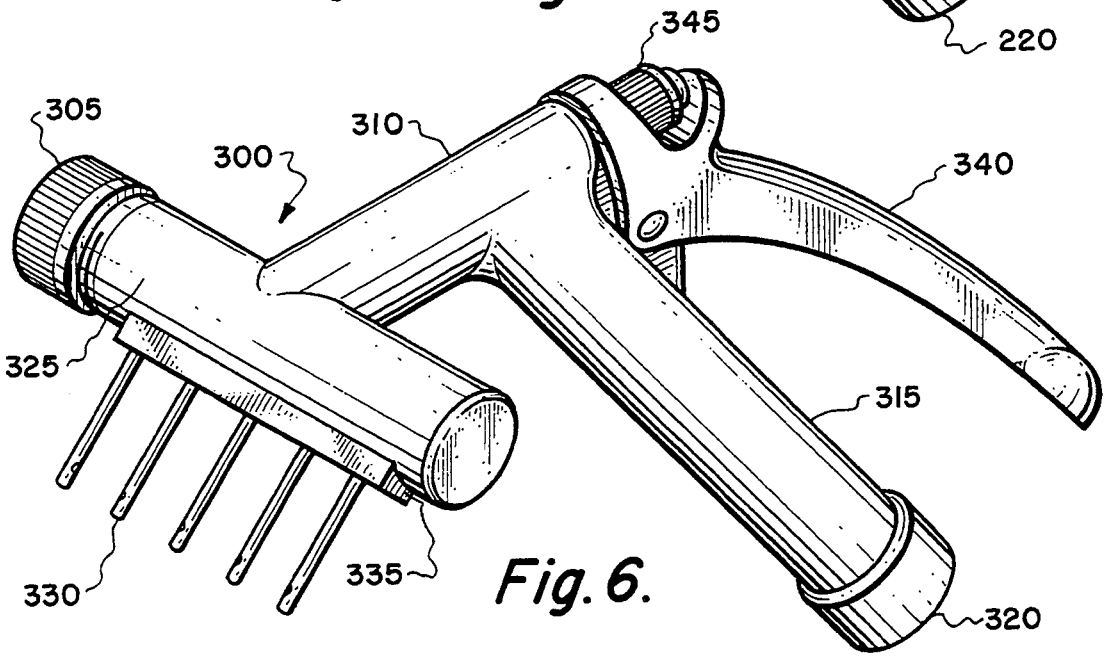
FIG. 6 is a second variant with a handgrip handle, and a water flow control lever attached to the handle.
Figure 7:
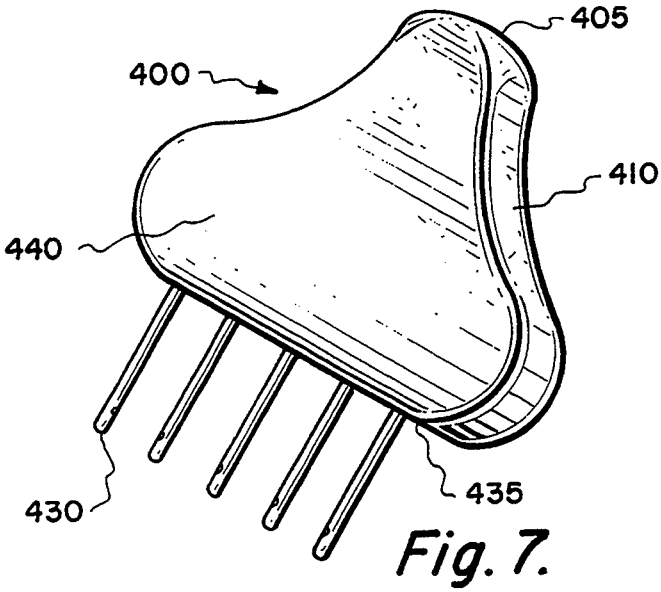
FIG. 7 is a third variant with a triangle-shaped housing with no stem.

Three variants or alternate embodiments of the invention are illustrated in FIGS. 5–7. The variant 200 illustrated in FIG. 5 is nearly identical to the preferred embodiment shown in FIGS. 1–4. In FIG. 5, the T-shaped configuration is illustrated. The head or transverse housing portion 225, the cap 205, the needles 230, the strengthening rib projection 235, and the fitting 220 are the same as those in the preferred embodiment. The stem 210 has been modified relative to the stem 100 in the preferred embodiment. A handgrip or handle 215 has been interposed between the end of the stem and the female fitting. The handle 215 provides a larger section for the user to grasp while using the first variant 200.

The variant 300 illustrated in FIG. 6 is nearly identical to the preferred embodiment shown in FIGS. 1–4. In FIG. 6, the T-shaped configuration is illustrated. The head or transverse housing portion 325, the cap 305, the needles 330, the strengthening rib projection 335, and the fitting 320 are the same as those in the preferred embodiment. The stem 310 has been modified relative to the stem 100 in the preferred embodiment. A handgrip or handle 315 has been interposed between the end of the stem and the female fitting. Additionally, a liquid control lever 340 and a lever adjustment range limit means 345 have been added. This second variant is identical to the variant in FIG. 5 with the addition of the liquid or water control means 340 and 345 attached to the handle 315. The water control lever 340 allows the user to control the water flow at the location of the present invention rather at the faucet end of the garden hose. The lever limit means 345 can be adjusted so that even when the lever 340 is squeezed to the maximum the water flow is still limited by adjusting the limit means 345. Both are added for the convenience of the user.

The third variant or alternate embodiment 400 is illustrated in FIG. 7. In the third variant, the T-shaped configuration has been modified to form a hollow generally triangle-shaped housing 440. The space between the outside walls of the stem and the housing has been encompassed by the triangle shape to eliminate the stem. The female fitting has also been encompassed by the triangle housing. The socket 405 having female threads is located internally at the apex area of the triangle housing. The rib projection 335 has been eliminated. The face at the base of the triangle where the needles 430 are mounted has a wall thickness greater than the wall thickness of the housing 50 in the preferred embodiment. The flange of each needle has been modified to form a male threaded fitting. The wall 435 of the triangle has a series of spaced apart threaded holes drilled into it for receiving the male threaded ends of the needles. The base of each needle is threaded into their respective threaded openings in the housing. If desired the threaded openings could be made at an angle relative to the face 435 to mount the needles in an angular position such as the needles in the other embodiments.

While the present invention has been shown and described herein in what is conceived to be the best mode contemplated, it is recognized that departures may be made therefrom within the scope of the invention which is therefore not to be limited to the details disclosed herein, but is to be afforded the full scope of the invention.

I claim:

1. Paintbrush cleaning apparatus comprising: hollow housing;

connecting means on said hollow housing for connecting a conduit means for delivering pressurized water to said hollow housing;

water jet means extending from said hollow housing for allowing pressurized water to flow out of said water jet means to clean a paint laden paintbrush; and said water jet means comprises a plurality of water jet needles spaced about one-half inch apart and aligned in a row and extending from said hollow housing each said water jet needle comprises:

a stem having a bore running therethrough for connecting to the hollow housing;

said stem is rigid and one inch to two inches in length and less than 0.25 inches in diameter; and said bore of said stem has a small diameter to cause a thin stream of water to exit said needle under high pressure.

2. The paintbrush cleaning apparatus as recited in claim 1, wherein:

said hollow housing comprises:

a transverse hollow head portion having a chamber;

a longitudinal hollow stem portion extending from said transverse hollow head portion;

said plurality of water jet needles extending from said transverse head portion and communicating with the chamber;

each said water jet needle further comprises:

a base positioned at one end of said stem for forming a seat for anchoring said needle in said wall of said head portion.

3. The apparatus as recited in claim 2 wherein said row of water jet needles are positioned at a 40 to 50 degree angle relative to the axis of said hollow stem portion.

4. The apparatus as recited in claim 2 further comprising: said transverse hollow head portion is cylinder-shaped and having at least one open end;

said open end of said head portion having a removable cap means for allowing the apparatus to be cleaned after extended use by removing said cap means and allowing water to flow through to flush and clean the apparatus.

5. The apparatus as recited in claim 2 further comprising:

water control means positioned adjacent said stem portion for allowing the user to control the flow of pressurized water at the apparatus.

6. The apparatus as recited in claim 5 wherein said water control means comprises:

a squeezable lever having a control knob.

7. The paintbrush cleaning apparatus as recited in claim 1, wherein:

said hollow housing comprises:

a transverse hollow head portion having a chamber;

a longitudinal hollow stem portion extending from said transverse hollow head portion for forming a generally L-shaped housing with said transverse head portion; and

8. The apparatus as recited in claim 2 further comprising:

said transverse hollow head portion is box-shaped and having at least one open end;

said open end of said head having a removable cap means for allowing the apparatus to be cleaned after extended use by removing said cap means and allowing water to flow through to flush and clean the apparatus.

9. Paintbrush cleaning apparatus comprising:

hollow housing;

said hollow housing comprises:

a transverse hollow head portion having a chamber;

a longitudinal hollow stem portion extending from said transverse hollow head portion for forming a generally T-shaped housing with said transverse head portion;

connecting means on said hollow housing for connecting a conduit means for delivering pressurized water to said hollow housing;

water jet means extending from said hollow housing for allowing pressurized water to flow out of said water jet means to clean a paint laden paintbrush;

said water jet means comprises a plurality of water jet needles spaced about one-half inch apart and aligned in a row and extending from said transverse head portion;

each said water jet needle comprises:

a thin hollow stem having a bore running therethrough for connecting to the chamber of said head; and a circular flange positioned at one end of said stem for forming a seat for anchoring said needle in said wall of said head.

10. Paint brush cleaner comprising:

a generally triangle-shaped hollow housing having a base area and an apex area;

means at said apex area for connecting a water hose;

water jet means extending from said base area of said hollow housing for allowing pressurized water to flow out from said water jet means to clean a used paintbrush;

said water jet means comprises a plurality of water jet needles spaced about one-half inch apart and aligned in a row and extending from said base area of said housing;

each said water jet needle comprises:

a thin hollow stem having a bore running therethrough for connecting to said hollow housing;

a circular flange positioned at one end of said stem for forming a seat for anchoring said needle to said hollow housing;

said bore of said stem is a small diameter to cause a thin stream of water to exit said needle under high pressure.

11. Paintbrush cleaner comprising:

transverse cylinder-shaped head formed from a cylinder-shaped wall closed at one end and open at the other end;

connecting means on said cylinder-shaped head for connecting a water hose means; removable cap means on said open end for allowing the apparatus to be flushed out and cleaned;

a row of water jet means positioned in and extending from said cylinder-shaped head portion for allowing pressurized liquid flowing from said conduit means to pass through said water jet means to clean a paintbrush and said row of water jet means comprises a plurality of water jet needles spaced about one-half inch apart and aligned in a row and extending from said transverse head portion each said water jet needle comprises:

a stem having a bore running therethrough for connecting to the transverse head portion;

said stem is rigid and one inch to two inches in length and less than 0.25 inches in diameter; and said bore of said stem has a small diameter to cause a thin stream of water to exit said needle under high pressure.

12. The apparatus as recited in claim 11 further comprising:

handle grip means positioned between said head and said connecting means for allowing a user to hold and manipulate the apparatus.

13. The apparatus as recited in claim 12 further comprising: water control means positioned adjacent said stem portion for allowing a user to control the flow of pressurized water at the apparatus.

14. The apparatus as recited in claim 13 wherein said water control means comprises:

a squeezable lever having a control knob.

* * * * *